US011376517B2

(12) United States Patent
Hsu

(10) Patent No.: US 11,376,517 B2
(45) Date of Patent: Jul. 5, 2022

(54) ROTARY DISPLACEMENT STRUCTURE OF FUN DEVICE

(71) Applicant: FOLUCK INTERNATIONAL CO., LTD., Taoyuan Hsien (TW)

(72) Inventor: Ming-Tay Hsu, Taoyuan Hsien (TW)

(73) Assignee: FOLUCK INTERNATIONAL CO., LTD., Taoyuan (TW)

( * ) Notice: Subject to any disclaimer, the term of this patent is extended or adjusted under 35 U.S.C. 154(b) by 0 days.

(21) Appl. No.: 17/033,929

(22) Filed: Sep. 28, 2020

(65) Prior Publication Data

US 2022/0096948 A1 Mar. 31, 2022

(51) Int. Cl.
*B43K 29/00* (2006.01)
*A63H 33/22* (2006.01)

(52) U.S. Cl.
CPC ..... *A63H 33/22* (2013.01); *B43K 29/00* (2013.01)

(58) Field of Classification Search
CPC ..... B43K 29/00; A63H 23/00; A63H 23/10; A63H 23/16
USPC ..... 446/166–167, 236, 267, 153–165, 74; 401/195
See application file for complete search history.

(56) References Cited

U.S. PATENT DOCUMENTS 3,382,606 A * 5/1968 Johnson ..... A63H 23/08 446/198
2007/0036608 A1* 2/2007 Jones ..... B43K 29/007 401/195
2008/0175650 A1* 7/2008 Geddes ..... B65D 81/36 401/195
2011/0103877 A1* 5/2011 Liu ..... B43K 29/00 401/195

* cited by examiner

*Primary Examiner* — Kien T Nguyen
(74) *Attorney, Agent, or Firm* — Chun-Ming Shih; HDLS IPR Services

(57) ABSTRACT

A rotary displacement structure of a fun device includes a container body. The container body has a space therein. A fluid is provided in the space. A rotary displacement unit is disposed in the space. The rotary displacement unit has buoyancy or gravity. The rotary displacement unit includes at least one blade assembly. When the container body is overturned, the rotary displacement unit will rise or descend through buoyancy or gravity. At the same time, the blade assembly enables the rotary displacement unit to rotate when ascending or descending, so as to obtain a different visual effect from the prior art.

7 Claims, 5 Drawing Sheets

ROTARY DISPLACEMENT STRUCTURE OF FUN DEVICE

FIELD OF THE INVENTION

The present invention relates to an interesting therapeutic device, and more particularly to an interesting therapeutic device having an interior rotary displacement unit that can rotate while rising or descending after the interesting therapeutic device is overturned.

BACKGROUND OF THE INVENTION

There are transparent pens or decorative devices on the market, and their interior space is filled with a fluid. A decoration is provided in the space. The decoration has buoyancy or gravity. When the pen is upright under normal conditions, the decoration will float at the top of the space. When the pen is overturned, initially, the decoration will be at the bottom of the space, and then it will slowly move towards the top of the space because of its buoyancy or gravity; thereby, an interesting effect can be achieved. This kind of interesting pen has existed for at least several decades. Although it is still fun, it is difficult to attract consumers' attention if it is no longer innovative.

SUMMARY OF THE INVENTION

In order to achieve creative movement and visual effects of the aforementioned pen, the primary object of the present invention is to provide a rotary displacement structure of a fun device, comprising a rotary displacement unit therein. Particularly, the rotary displacement unit can rotate when the rotary displacement unit rises or descends. In this way, the rotary displacement unit can be rotated while rising or descending. If the surface of the rotary displacement unit is printed with characters, lines, color blocks or patterns, the visual effect will be completely different from the prior art, which can effectively attract consumers' attention, increase the desire to purchase and greatly enhance the healing effect.

In order to achieve the aforesaid object, a rotary displacement structure of a fun device is provided. The rotary displacement structure of the fun device comprises a container body. The container body includes an outer tube. The outer tube is a hollow and closed tube and has a space therein. A fluid is provided in the space. A rotary displacement unit is disposed in the space. The rotary displacement unit includes at least one blade assembly. The rotary displacement unit is movable in the space through buoyancy or gravity.

In a preferred embodiment, the container body is a transparent container body.

In a preferred embodiment, the rotary displacement unit has buoyancy or gravity and includes an inner tube. The inner tube has an air chamber therein, or the specific weight of the rotary displacement unit is relatively less than that of the fluid in the space so that buoyancy can be obtained; alternatively, an appropriate weight is added to the rotary displacement unit in advance to obtain its gravity. As a result, the rotary displacement unit can automatically rise or descend in the fluid in the space.

In a preferred embodiment, the blade assembly includes a plurality of blades. A surface of each blade and a horizontal plane are arranged at an acute angle.

In a preferred embodiment, either end of the rotary displacement unit is provided with the blade assembly.

In a preferred embodiment, a surface of the rotary displacement unit is printed with characters, lines, color blocks or patterns.

In a preferred embodiment, the container body is a pen. Opposing two ends of the container body are provided with a cover and a pen point, respectively.

In a preferred embodiment, the container body is a decoration.

BRIEF DESCRIPTION OF THE DRAWINGS

Embodiments of the present invention will now be described, by way of example only, with reference to the accompanying drawings.

DETAILED DESCRIPTION OF THE PREFERRED EMBODIMENTS

Figure 1:
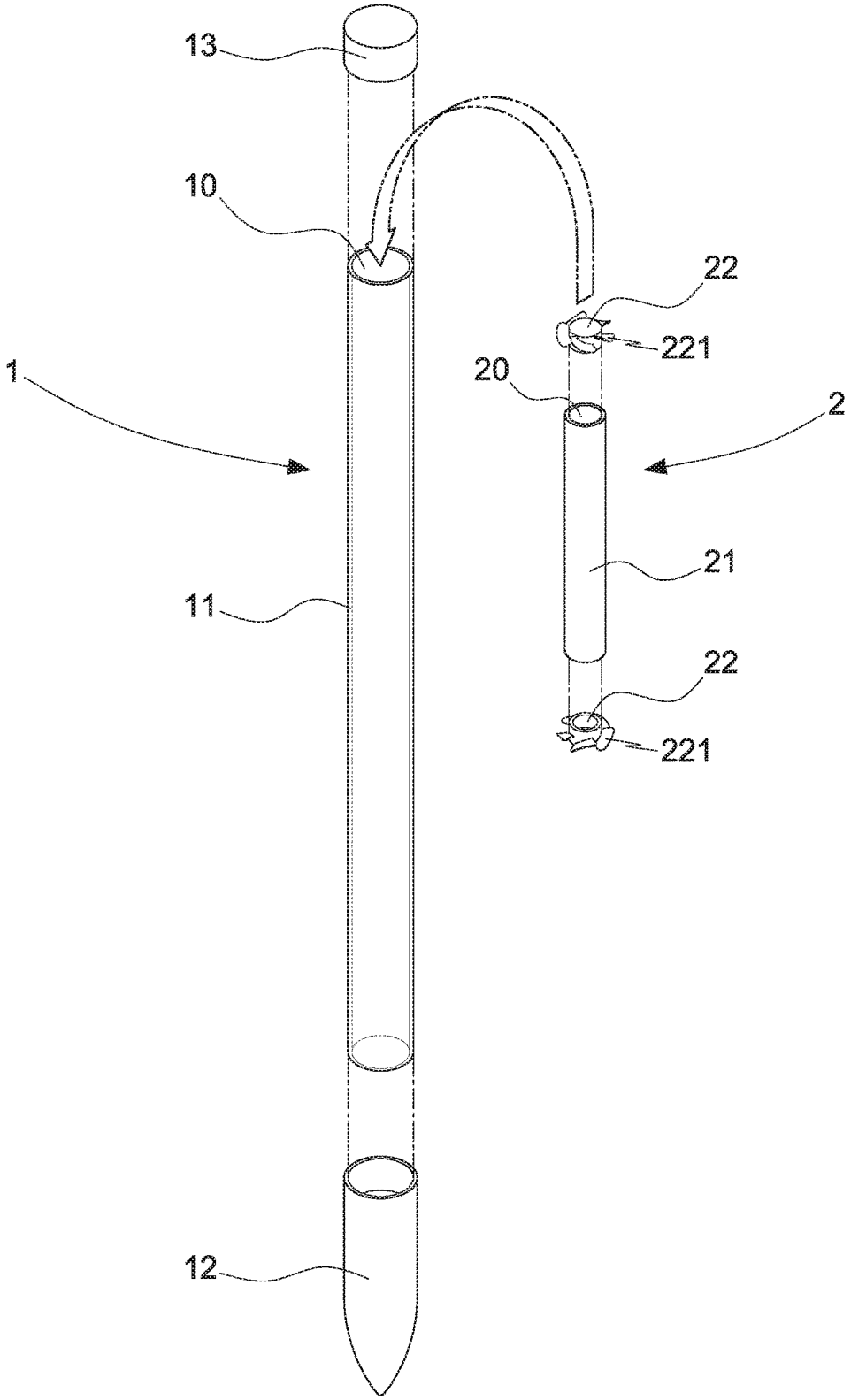
FIG. 1 is an exploded view of the present invention.
Figure 2:
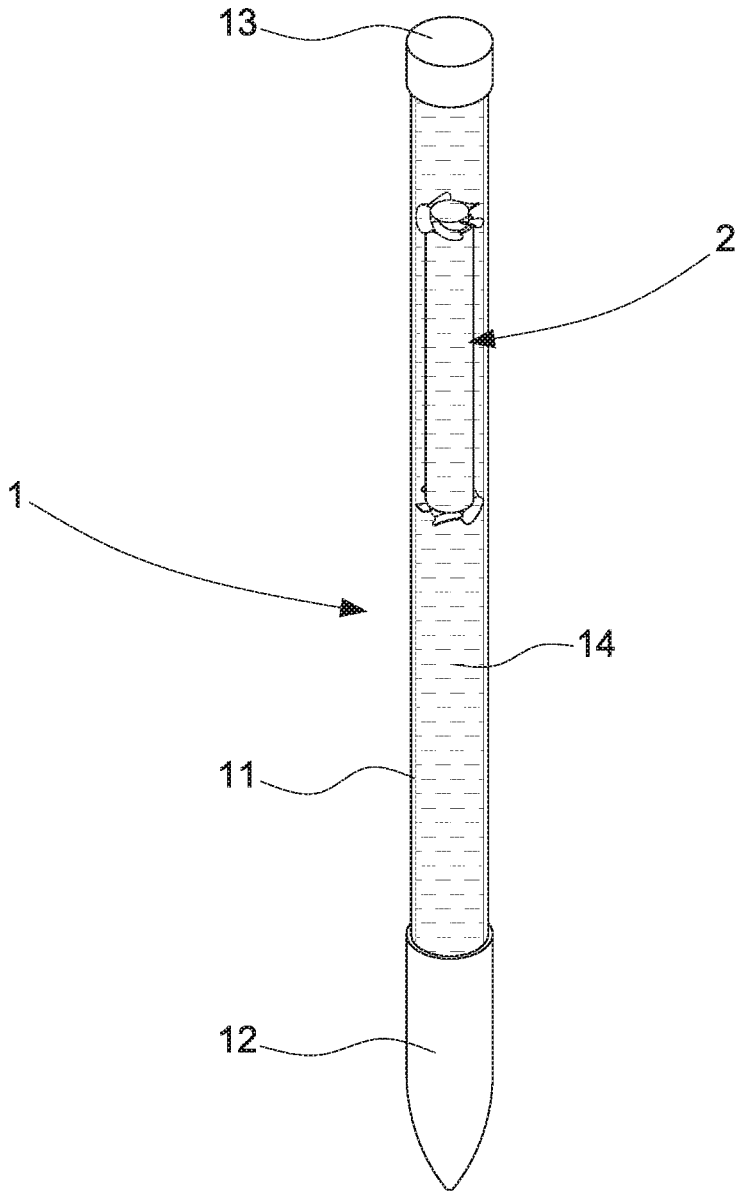
FIG. 2 is a perspective view of the present invention.
Figure 3:
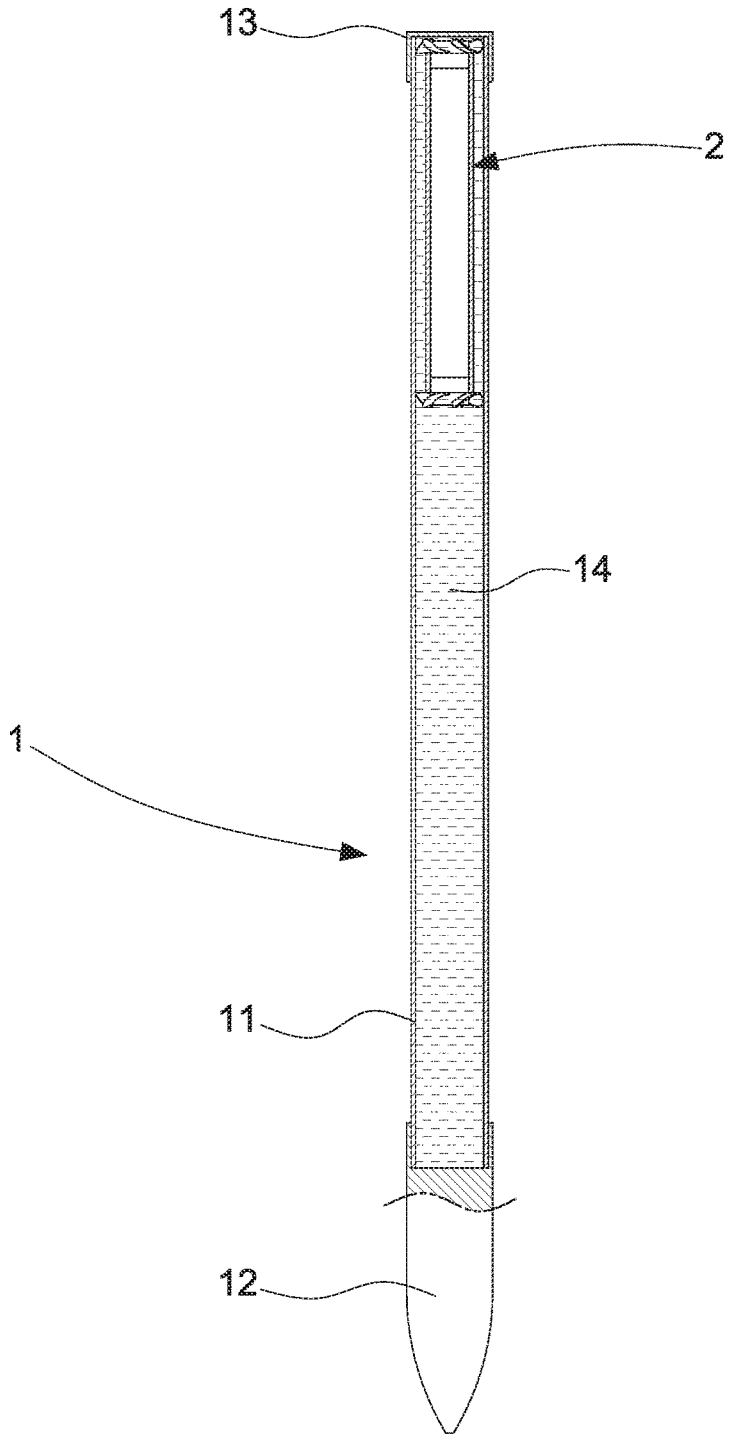
FIG. 3 is a cross-sectional view of the present invention.

As shown in FIG. 1 through FIG. 3, the present invention discloses a rotary displacement structure of a fun device, comprising a container body 1. The container body 1 includes an outer tube 11. The outer tube 11 is a hollow and closed tube, and has a space 10 therein. A fluid 14 is provided in the space 10. A rotary displacement unit 2 is provided in the space 10. The rotary displacement unit 2 includes a tube 21 a blade assembly 22. The rotary displacement unit 2 is movable in the space 10. The container body 1 is a transparent container body. The rotary displacement unit 2 has an air chamber 20 in the tube 21, or the specific weight of the rotary displacement unit 2 is relatively less than that of the fluid 14 in the space 10 so that buoyancy can be obtained; alternatively, an appropriate weight is added to the rotary displacement unit 2 in advance to obtain its gravity. As a result, the rotary displacement unit 2 can automatically rise or descend in the fluid 14 in the space 10. The blade assembly 22 includes a plurality of blades 221. A slight angle is defined between the surface of each blade 221 and the horizontal plane. Preferably, either end of the rotary displacement unit 2 is provided with the blade assembly 22. The surface of the rotary displacement unit 2 is printed with characters, lines, color blocks or patterns. The container body is a pen. A cover 13 and a pen point 12 are provided at opposing two ends of the container body 1, respectively.

As shown in FIG. 3, the rotary displacement unit 2 has buoyancy, as an example. Since the rotary displacement unit 2 has buoyancy, the rotary displacement unit 2 floats on the top of the fluid 14 in the space 10 in normal conditions.

Figure 4:
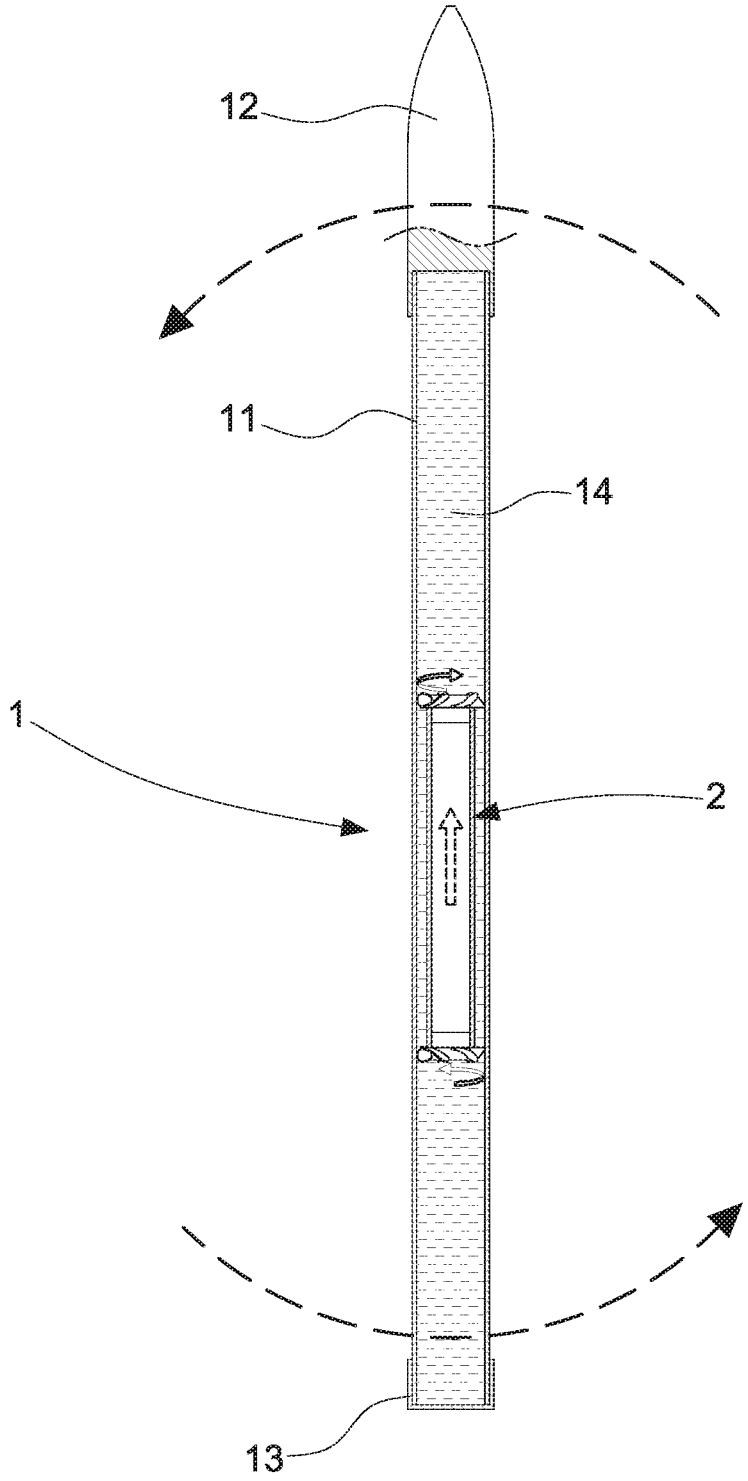
FIG. 4 is a schematic view of the present invention to be overturned.
Figure 5:
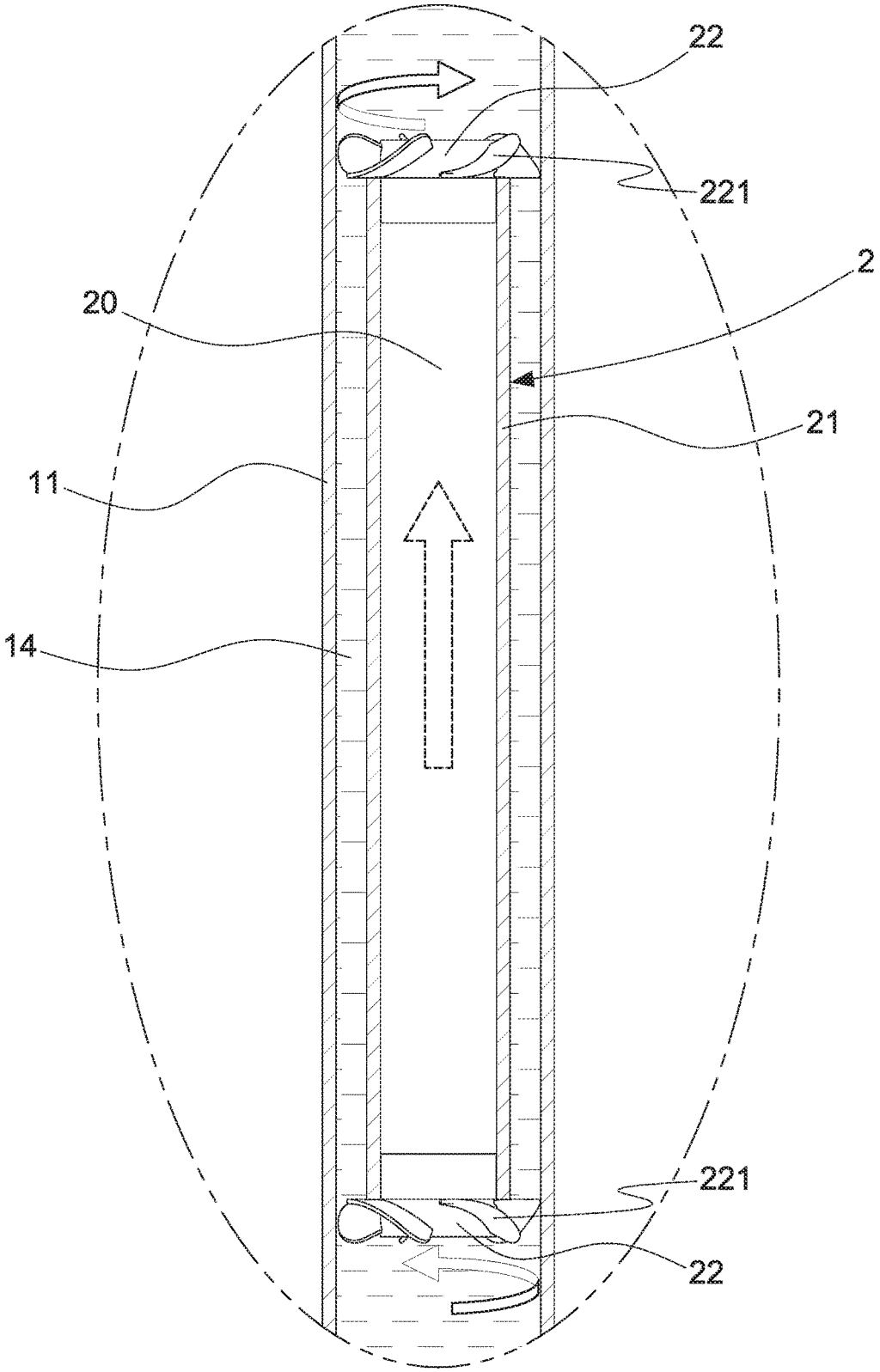
FIG. 5 is a schematic view of the present invention after being overturned, illustrating that the rotary displacement unit floats and rotates upward.

As shown in FIG. 4, when the container body 1 is quickly overturned manually, the rotary displacement unit 2 originally located at the top of the fluid 14 in the space 10 will become at the bottom of the fluid 14. Because the rotary displacement unit 2 has buoyancy, the rotary displacement unit 2 will slowly rise upward (as shown in FIG. 5). At the same time, the rotary displacement unit 2 will rotate through the blade assembly 22. Therefore, the rotary displacement unit 2 will slowly rotate and float upward until it reaches the top of the fluid 14 in the space 10. Moreover, if the surface of the rotary displacement unit 2 are printed with various characters, lines, color blocks or patterns, the visual effect is different from the prior art.

If the rotary displacement unit 2 is pre-set with a proper weight, that is, the specific weight of the rotary displacement unit 2 is relatively greater than that of the fluid 14, the rotary displacement unit 2 rotates while the fluid 14 descends.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rotary displacement structure of a fun device, comprising:

a tubular container body, the tubular container body being hollow and closed and having a space therein, a fluid being provided in the space;

a rotary displacement unit, disposed in the space, the rotary displacement unit having one of buoyancy or gravity, the rotary displacement unit including a tube and a blade assembly, the rotary displacement unit being rotatable and movable along a longitudinal direction of the tubular container body in the space; wherein the tubular container body is a pen, and opposing two ends of the tubular container body are provided with a cover and a pen point, respectively.

2. The rotary displacement structure of the fun device as claimed in claim 1, wherein the tubular container body is a transparent container body.

3. The rotary displacement structure of the fun device as claimed in claim 1, wherein the rotary displacement unit has an air chamber therein.

4. The rotary displacement structure of the fun device as claimed in claim 1, wherein the rotary displacement unit has a specific weight less than that of the fluid in the space.

5. The rotary displacement structure of the fun device as claimed in claim 1, wherein the blade assembly includes a plurality of blades, and a surface of each blade and a horizontal plane are arranged at an acute angle.

6. The rotary displacement structure of the fun device as claimed in claim 1, wherein either end of the rotary displacement unit is provided with the blade assembly.

7. The rotary displacement structure of the fun device as claimed in claim 1, wherein the rotary displacement unit has a specific weight greater than that of the fluid in the space.

* * * * *